United States Patent [19]

Wilson

[11] 4,254,981

[45] Mar. 10, 1981

[54] GOLF BALL RETRIEVER

[76] Inventor: Albert C. Wilson, 8628 Cantore Pl., Sarasota, Fla. 33580

[21] Appl. No.: 51,942

[22] Filed: Jun. 25, 1979

[51] Int. Cl.[3] ..... A63B 47/02

[52] U.S. Cl. ..... 294/19 A

[58] Field of Search ..... 294/19 A, 99 R; 56/328 R, 400.11, 400.18–400.21

[56] References Cited

U.S. PATENT DOCUMENTS

| | | | |
|---|---|---|---|
| 1,014,250 | 1/1912 | Norman | 56/400.11 |
| 1,095,585 | 5/1914 | Mack | 56/328 R |
| 2,083,786 | 6/1937 | Jerner et al. | 56/400.18 |
| 2,721,755 | 10/1955 | Walner | 294/19 A |
| 2,724,610 | 11/1955 | Fitzgerald | 294/19 A X |
| 2,738,214 | 3/1956 | Zimmers | 294/19 A |
| 3,210,111 | 10/1965 | Fallon | 294/19 A |
| 3,306,650 | 2/1967 | Zagwyn | 294/19 A X |
| 3,773,374 | 11/1973 | D'Luhy | 294/19 A |
| 4,136,901 | 1/1979 | Walter | 294/19 A |

FOREIGN PATENT DOCUMENTS

| | | | |
|---|---|---|---|
| 2791 | of 1902 | United Kingdom | 294/19 A |

*Primary Examiner*—Johnny D. Cherry

*Attorney, Agent, or Firm*—Benjamin P. Reese, II

[57] ABSTRACT

A golf ball retriever for retrieving golf balls from water hazards and other inaccessible places. The retriever consists essentially of an elongated handle having a flat plate attached to one end. The flat plate has a plurality of retrieving fingers pivotedly attached thereto. The free end of each finger is curved rearwardly in the general direction of the elongated handle and has an uncurved outermost portion which rises from the horizontal toward the elongated handle. A sliding bar is provided for maintaining the retrieving fingers in either a closely-spaced configuration or a spread-apart configuration. With the retrieving fingers in a spread-apart configuration, the distance between the free ends of adjacent fingers is slightly less than the diameter of a golf ball.

2 Claims, 5 Drawing Figures

GOLF BALL RETRIEVER

BACKGROUND AND SUMMARY OF THE INVENTION

This invention relates to a new and improved golf ball retriever for retrieving golf balls from water hazards and other inaccessible places.

Golf is a game whose object is to sink a small round ball into each of the successive holes on a course by using as few strokes as possible and avoiding various obstacles. The course for the game is usually laid out over a relatively large land area having natural or man-made water hazards and sand hazards and other natural or man-made obstacles to test the playing skill of the golfer. Occasionally, even a highly skilled professional golfer will have his or her golf ball land in one of these places. Accordingly, it is desirable to have means for conveniently retrieving a golf ball from such places.

Conventional rakes have been used as means for retrieving golf balls. Also, rake heads specially constructed for attachment to a golf club shaft or a golf club head are known in the art. While a rake makes an excellent tool for searching for a ball, it is a rather awkward implement for retrieving a ball. The primary reason for the awkwardness of a rake is that it cannot be used to engage a golf ball and lift it out of a water hazard or similar inaccessible place.

Various devices for scooping or dipping a golf ball from a water hazard or other inaccessible place are known in the art. Both U.S. Pat. No. 2,738,214, issued Mar. 13, 1956 to Zimmers and U.S. Pat. No. 3,306,650, issued Feb. 28, 1967 to Zagwyn disclose devices for both raking a golf ball and scooping or dipping a golf ball. Each of these devices has a long handle with a plate-like structure attached to one end. The plate-like structure has a plurality of fingers attached thereto. With the Zimmers device, a golf ball can be retrieved by positioning the fingers behind the ball and pulling the handle forward to engage the ball. When the ball is engaged by the fingers, the handle is lifted to remove the ball from the water hazard or other inaccessible place. Unfortunately, the ball often drops from the fingers when the handle is lifted.

With the Zagwyn device, the golf ball is located in the water hazard or other inaccessible place by raking with the fingers in a spread apart configuration. When the ball is located, the fingers are closed and a hoop slightly larger in diameter than a golf ball is positioned adjacent to the fingers to form a retaining net or basket for scooping or dipping the ball from the water hazard or other inaccessible place. Unfortunately, it is often difficult for a golfer to retrieve the ball with such a net or basket. For example, if such a device is used in a water hazard having a soft muddy bottom, the mud from the bottom often fills the net or basket and prevents the golfer from scooping or dipping the ball from the hazard. Also, the golfer may have difficulty seeing his or her ball in a water hazard because of suspended materials in the water or refraction of light rays passing through the air-water interface, or both.

The golf ball retriever of the present invention overcomes these and many other disadvantages of the Zimmers device, the Zagwyn device and other known devices for retrieving golf balls. The golf ball retriever of the present invention consists essentially of an elongated handle having a flat plate attached to one end. The flat plate has a plurality of retrieving fingers pivotedly attached thereto. Preferably, the elongated handle is of the telescopic extension type or the folding type and the entire retriever is constructed from an aluminum alloy or another suitable lightweight material.

The geometrical shape of each of the retrieving fingers is essentially that of an unbarbed fish hook. Accordingly, the free end of each finger is curved rearwardly in the general direction of the elongated handle and has an uncurved outermost portion which rises from the horizontal toward the elongated handle. The uncurved outermost portion of each retrieving finger has a longitudinal dimension slightly greater than the diameter of a conventional golf ball.

The golf ball retriever of the present invention provides mechanical means for holding the retrieving fingers in either a spread-apart configuration or a closely-spaced configuration. When the retrieving fingers are held in a spread-apart configuration, the distance between the free ends of adjacent fingers is slightly less than the diameter of a conventional golf ball. Thus, when the retrieving fingers engage a golf ball, the ball will seat itself between two adjacent fingers. This tends to prevent lateral displacement of the golf ball. And, of course, the ball is thereby prevented from moving in a direction away from the elongated handle. Furthermore, the rise of the uncurved outermost portion of each finger from the horizontal is a deterrent to movement of the golf ball in a direction toward the elongated handle when the handle is lifted by the golfer. For these reasons, the golf ball seldom drops from the golf ball retriever of the present invention when the retriever is being used to retrieve the ball from a water hazard or other inaccessible place.

When using the golf ball retriever of the present invention, it is not necessary for the golfer to first locate his or her ball by raking and then to retrieve the ball from the water hazard or other inaccessible place by scooping or dipping. The golfer simply pulls the golf ball retriever through the general area within which he believes his ball to be located. When the uncurved outermost portions of the retrieving fingers are drawn under the golf ball, the ball will seat itself between two adjacent fingers in the manner described above. Then, the golfer can lift the elongated handle to retrieve his or her ball. With the golf ball retriever of the present invention, the golfer can retrieve his or her ball from water hazards having muddy, sandy or hard bottoms.

These and many other advantages, features and objects of the present invention will be apparent from the following brief description of drawings, detailed description of the preferred embodiment and the appended claims.

DESCRIPTION OF THE PREFERRED EMBODIMENT

Figure 1:
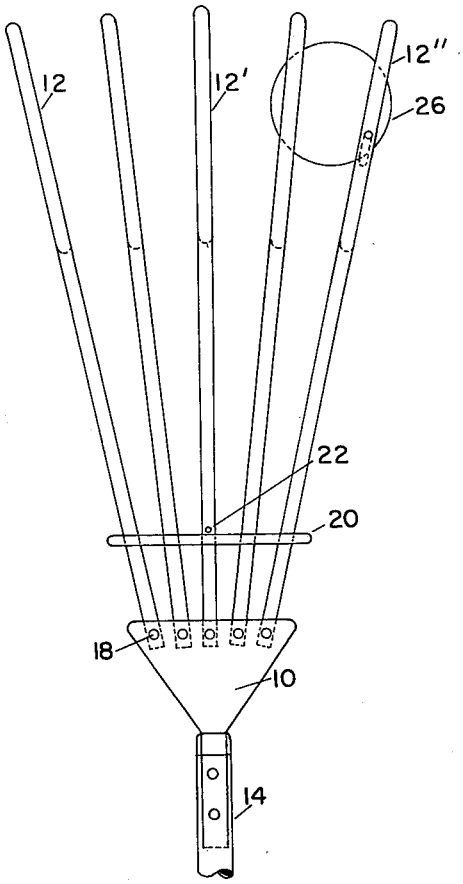
FIG. 1 is a top view of the golf ball retriever, with the handle deleted, showing the retrieving fingers in a spread-apart configuration.
Figure 2:
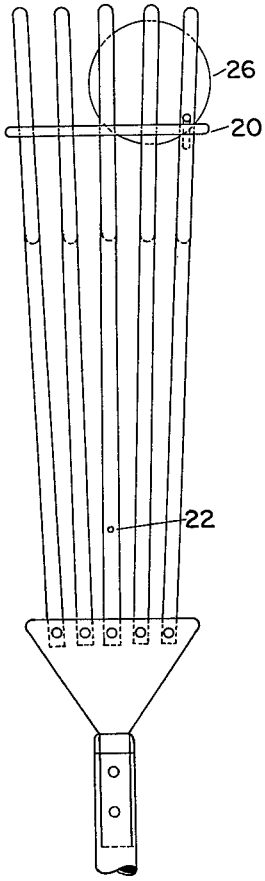
FIG. 2 is a top view of the golf ball retriever, with the handle deleted, showing the retrieving fingers in a closely-spaced configuration.
Figure 3:
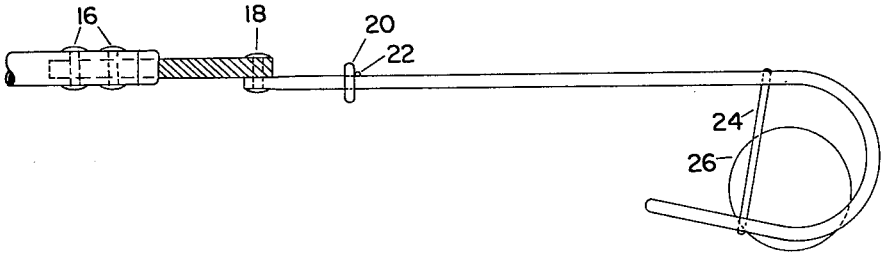
FIG. 3 is a side view of the golf ball retriever with the handle deleted.
Figure 4:
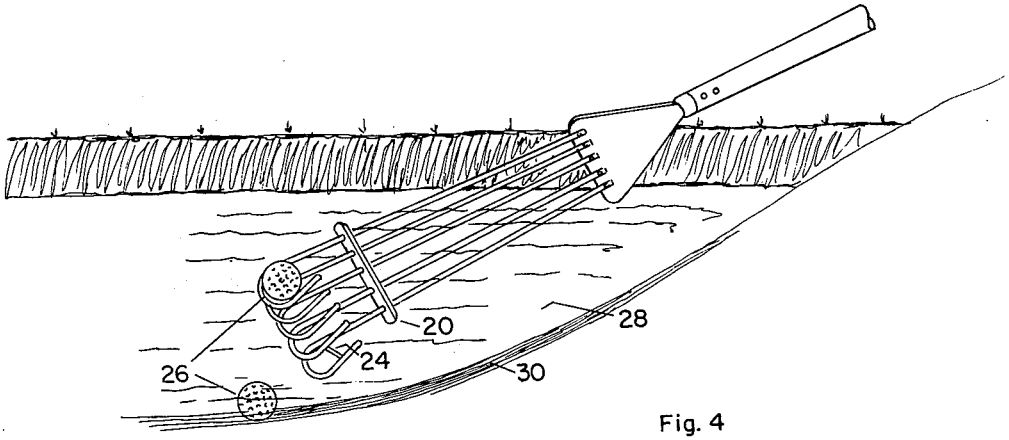
FIG. 4 is an isometric view of the golf ball retriever, with a telescopic handle shown fragmentarily, showing the retrieving fingers in a closely-spaced configuration.
Figure 5:
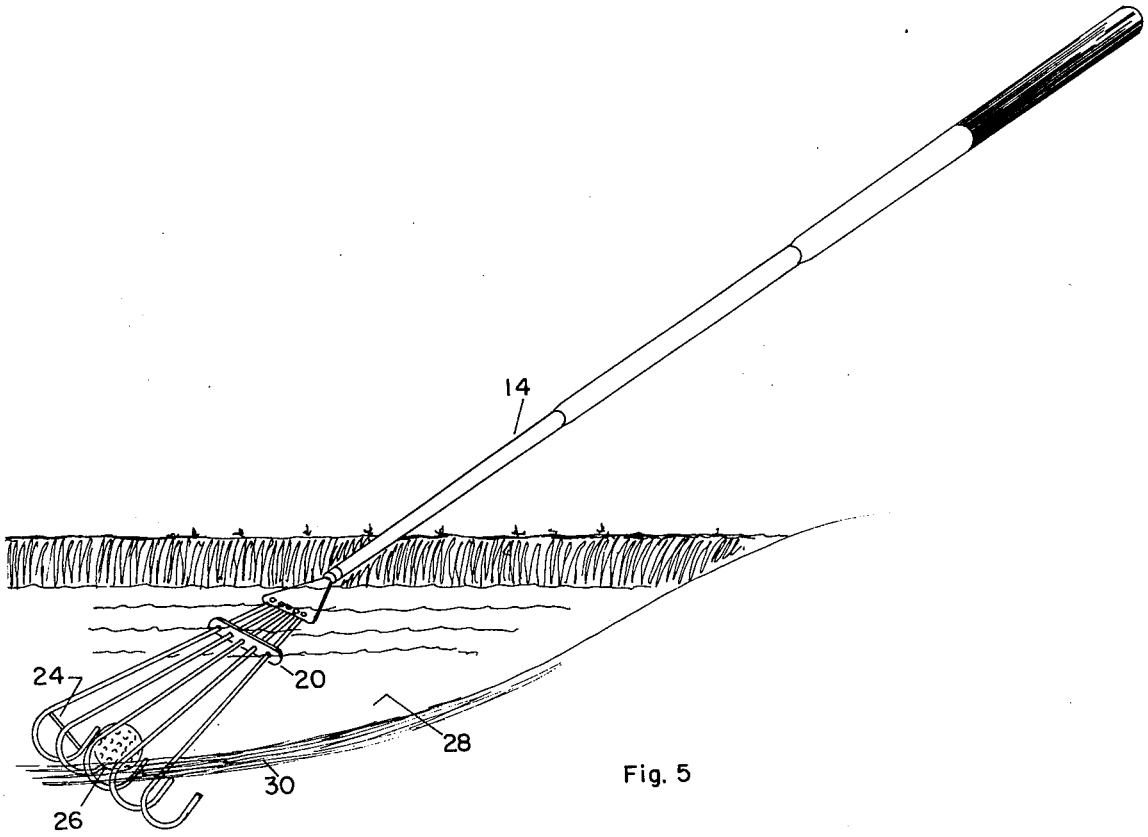
FIG. 5 is an isometric view of the golf ball retriever, with an extended telescopic handle, showing the retrieving fingers in a spread-apart configuration.

The golf ball retriever of the present invention is illustrated in FIGS. 1–5. FIGS. 1, 2 and 3 illustrate details of construction for the preferred embodiment of the golf ball retriever. FIGS. 4 and 5 illustrate two alternate methods for using the golf ball retriever.

The golf ball retriever consists essentially of a flat plate 10 having a plurality of retrieving fingers 12 pivotedly attached near one end thereof and an elongated handle 14 attached near the other end thereof. In the preferred embodiment, the flat plate 10 is generally triangular in shape with a rectangular shaped portion extending from the apex formed by two sides of the triangle. A pair of cylindrical holes are provided through the rectangular portion of the flat plate 10 for attachment of the elongated handle 14 by conventional fastening means, such as rivets 16.

Each of the retrieving fingers 12 has a straight elongated portion and a curved portion. The curved portion of each finger is curved rearwardly in the general direction of the elongated handle 14 and has an uncurved outermost portion which rises from the horizontal toward the elongated handle 14. This uncurved outermost portion has a longitudinal dimension slightly greater than the diameter of a golf ball. It will be readily seen by those skilled in the art that each retrieving finger 12 is shaped essentially like an unbarbed fish hook.

The flat plate 10 has a plurality of cylindrical holes therethrough located adjacent to the base of the triangular section thereof. Each of the curved retrieving fingers 12 has a cylindrical hole therethrough located near the end of its straight elongated portion. To pivotedly attach each of the retrieving fingers 12 to the flat plate 10, a rivet 18 engages the cylindrical hole through the retrieving finger 12 and one of the cylindrical holes through the flat plate 10. Of course, it is possible to use other fastening means, such as a lock-nut and a bolt, for this purpose.

A sliding bar 20 having a plurality of cylindrical holes therethrough is provided for holding the retrieving fingers 12 in either a spread-apart configuration or a closely-spaced configuration. Each of the cylindrical holes through the sliding bar 20 slidably engages one of the retrieving fingers 12. When the sliding bar 20 is positioned near the pivotedly attached ends of the retrieving fingers 12, the retrieving fingers 12 are held in a spread-apart configuration. When the sliding bar 20 is positioned near the free ends of the retrieving fingers 12, the retrieving fingers 12 are held in a closely-spaced configuration.

A ball bearing 22 is fitted in a hemispherical depression in the straight elongated portion of one of the retrieving fingers 12. This depression is located near the pivotedly attached end of said retrieving finger 12. Preferably, the center retrieving finger 12' is selected for said depression and said ball bearing. The ball bearing 22 functions as a stop for the sliding bar 20 when it is desired to use the golf ball retriever with the retrieving fingers 12 in a spread-apart configuration. Of course, other mechanical means, such as a removable pin in a cylindrical hole through the straight elongated portion of one of the retrieving fingers 12, could be used as a stop for the sliding bar 20. And, a latch could be provided on the sliding bar 20 for engaging a hook, hole or fixed pin on the flat plate 10. Of course, this could be reversed and a latch provided on the flat plate 10 for engaging a hook, hole or fixed pin on the sliding bar 20.

With the retrieving fingers 12 in a spread-apart configuration, the distance between the free ends of adjacent retrieving fingers 12 is slightly less than the diameter of a conventional golf ball. It will be readily seen by those skilled in the art that this feature enables the golf ball retriever of the present invention to be used to retrieve golf balls by positioning the retrieving fingers 12 behind the ball and pulling the elongated handle 14 to cause two adjacent retrieving fingers 12 to engage the ball.

When it is desired to use the golf ball retriever with the retrieving fingers 12 in a closely-spaced configuration, the golfer presses the ball bearing 22 into the hemispherical depression and slides the sliding bar 20 toward the curved portions of the retrieving fingers 12. A retaining rod 24 having one end attached to the straight elongated portion and the other end attached to the uncurved outermost portion of one of the end retrieving fingers 12'' prevents sliding bar 20 from sliding off the free ends of the retrieving fingers 12. The retaining rod 24 is positioned such that a golf ball will rest in the area bounded by the retaining rod 24 and the curved portion of the end retrieving finger 12'' without dropping through said area. It will be readily seen by those skilled in the art that this feature enables the golf ball retriever of the present invention to be used as a net or basket for scooping or dipping easy to see and easy to reach golf balls from a water hazard or other inaccessible place.

The golf ball retriever of the present invention is not limited by the structural materials selected for its construction. However, it is well known that a lightweight retrieving device is preferred by most golfers. For this reason, a tubular aluminum alloy telescoping handle was selected for the elongated handle 14. Aluminum alloy plate was selected for the flat plate 10 and an aluminum alloy bar was selected for sliding bar 20. Also, aluminum rods were selected for the retrieving fingers 12 and the retaining rod 24.

Having described the construction of the golf ball retriever of the present invention, its storage and use by a typical golfer will now be described. The golf ball retriever is stored with the sliding bar 20 positioned near the curved portions of the retrieving fingers 12. Accordingly, the retrieving fingers 12 are maintained in a closely-spaced configuration for storage. The elongated handle 14 is maintained in its nested configuration for storage. It will be readily seen by those skilled in the art that this enables the golf ball retriever to be conveniently stored in a conventional golf bag.

Referring now to FIGS. 4 and 5, the golfer inadvertently drives his or her golf ball 26 into water hazard 28 and the ball comes to rest on the bottom 30. If the golf ball 26 is located near the edge of the water hazard 28 and is clearly visible to the golfer, the golfer removes the golf ball retriever from his or her golf bag and extends the elongated handle 14. Then, with the retrieving finger 12 in a closely-spaced configuration, the retriever is used to scoop or dip the golf ball 26 from the water hazard 28 in the manner illustrated in FIG. 4.

If the golf ball 26 is located a considerable distance from the edge of the water hazard 28, the golfer removes the golf ball retriever from his or her golf bag and slides the sliding bar 20 to a location rearward of the ball bearing 22 to hold the retrieving fingers 12 in a spread-apart configuration. Then the golfer extends the elongated handle 14 to its maximum length and uses the handle to position the retrieving fingers 12 behind the golf ball 26 in the manner illustrated in FIG. 5. The elongated handle 14 is lifted by the golfer to retrieve the golf ball 26 from the water hazard 28. This procedure is also recommended when the golf ball 26 is located near the edge of the water hazard 28 if the ball is not clearly visible to the golfer or if the bottom 30 of water hazard 28 is muddy.

While the present invention has been disclosed in connection with the preferred embodiment thereof, it should be understood that there may be other embodiments which fall within the spirit and scope of the invention as defined by the claims.

I claim:

1. A golf ball retriever, comprising:

(a) an elongated handle;

(b) a flat plate attached to one end of said elongated handle;

(c) a plurality of retrieving fingers, each having a straight elongated portion pivotedly attached to said flat plate and a curved portion with an uncurved outermost portion which rises from the horizontal toward said elongated handle;

(d) a sliding bar which engages each of said retrieving fingers for maintaining said retrieving fingers in a spread-apart configuration having a distance between adjacent fingers which is slightly less than the diameter of a golf ball when positioned near the pivotedly attached ends of said retrieving fingers and for maintaining said retrieving fingers in a closely-spaced configuration when positioned near the free ends of said retrieving fingers; and (e) a ball bearing fitted in a hemispherical depression in the straight elongated portion of one of said retrieving fingers to function as a stop for maintaining said sliding bar in a position near the pivotedly attached ends of said retrieving fingers.

2. A golf ball retriever as recited in claim 1, further comprising a retaining rod having one end attached to the straight elongated portion and the other end attached to the uncurved outermost portion of one of the end retrieving fingers for preventing said sliding bar from sliding off the free ends of said retrieving fingers and for retaining a golf ball when using the golf ball retriever as a net or basket for retrieving golf balls by scooping or dipping.

* * * * *